US010914211B2

(12) United States Patent
Tada

(10) Patent No.: US 10,914,211 B2
(45) Date of Patent: Feb. 9, 2021

(54) INTERNAL COMBUSTION ENGINE WITH GAS-LIQUID SEPARATOR FOR BLOWBY GAS

(71) Applicant: HONDA MOTOR CO., LTD., Tokyo (JP)

(72) Inventor: Kazushi Tada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 29 days.

(21) Appl. No.: 16/272,364

(22) Filed: Feb. 11, 2019

(65) Prior Publication Data

US 2019/0277172 A1 Sep. 12, 2019

(30) Foreign Application Priority Data

Mar. 9, 2018 (JP) ..... 2018-042918

(51) Int. Cl.
*F01M 13/04* (2006.01)
*F02F 7/00* (2006.01)
(Continued)

(52) U.S. Cl.
CPC ..... *F01M 13/0416* (2013.01); *F02F 7/006* (2013.01); *F02M 35/10222* (2013.01);
(Continued)

(58) Field of Classification Search
CPC ..... F01M 13/00; F01M 13/0416; F01M 13/0011; F01M 2013/0461; F02M 25/06; F02M 35/10222
(Continued)

(56) References Cited

U.S. PATENT DOCUMENTS 4,382,427 A * 5/1983 Lyndhurst ..... F01P 3/02 123/41.74
4,425,881 A * 1/1984 Lyndhurst ..... F02B 29/0475 123/184.34
(Continued)

FOREIGN PATENT DOCUMENTS

CN 101684764 A 3/2010
CN 104685173 A 6/2015
(Continued)

OTHER PUBLICATIONS

20. What is a hot V Turbo Engine Layout and What benefit does it have, 2017 [Retrieved on May 20, 2020]. Retrieved from the Internet: https://www.carthrottle.com/post/what-is-a-hot-v-turbo-engine-layout-and-what-benefits-does-it-have/ (Year: 2017).*
(Continued)

*Primary Examiner* — Jacob M Amick
*Assistant Examiner* — Michael A Kessler
(74) *Attorney, Agent, or Firm* — Armstrong Teasdale LLP

(57) ABSTRACT

An internal combustion engine (1) includes an internal combustion engine main body (20), a head cover (11, 15) attached to an upper end part of the internal combustion engine main body, and an exhaust system (34) connected to the internal combustion engine main body, and a gas-liquid separator (45, 60) for blowby gas provided in the head cover. A part of the exhaust system is positioned adjacent to the internal combustion engine main body in a first direction (X) along a cylinder row, and the gas-liquid separator is positioned in the head cover so as to be offset in the first direction.

6 Claims, 10 Drawing Sheets

(51) Int. Cl.
*F02B 75/22* (2006.01)
*F02M 25/06* (2016.01)
*F02M 35/10* (2006.01)

(52) U.S. Cl.
CPC ..... *F01M 2013/0461* (2013.01); *F01M 2013/0477* (2013.01); *F02B 75/228* (2013.01); *F02M 25/06* (2013.01)

(58) Field of Classification Search
USPC ..... 123/572–574
See application file for complete search history.

(56) References Cited

U.S. PATENT DOCUMENTS

| | | | |
|---|---|---|---|
| 4,541,399 | A | 9/1985 | Tanaka et al. |
| 9,506,425 | B2 | 11/2016 | Sato et al. |
| 2015/0275719 | A1 | 10/2015 | Shunsuke et al. |

FOREIGN PATENT DOCUMENTS

| | | | | |
|---|---|---|---|---|
| CN | 206309444 | U | | 7/2017 |
| CN | 107524538 | A | | 12/2017 |
| EP | 2163738 | A1 | | 3/2010 |
| JP | 2003293725 | A | * | 10/2003 |
| JP | 2007138823 | A | | 6/2007 |
| JP | 2007224736 | A | * | 9/2007 |
| JP | 2008075630 | A | | 4/2008 |
| JP | 2009013941 | A | | 1/2009 |
| JP | 2015113820 | A | | 6/2015 |
| JP | 2017198123 | A | | 11/2017 |

OTHER PUBLICATIONS

21. Turbo Placement on BMW V-8 May be New Design Trend, 2009 [Retrieved on May 20, 2020]. Retrieved from Internet: https://www.wardsauto.com/news-analysis/turbo-placement-bmw-v-8-may-be-new-design-trend. (Year: 2009).*

American Heritage Dictionary Offset (Year: 2020).*

English machine translation of description of JP 2003293725 A provided by ESPACENET (Year: 2020).*

English translation of Notice of Reasons for Refusal for JP application No. 2018-042918, dated Aug. 27, 2019, 3 pages.

China Office Action for Chinese Patent Application 201910176350.6 dated Oct. 29, 2020; 16 pp.

* cited by examiner

INTERNAL COMBUSTION ENGINE WITH GAS-LIQUID SEPARATOR FOR BLOWBY GAS

TECHNICAL FIELD

The present invention relates to an internal combustion engine provided with a gas-liquid separator for blowby gas.

BACKGROUND OF THE INVENTION

It is known to provide a gas-liquid separator in a head cover of an internal combustion engine for separating oil contained in the blowby gas. When the ambient temperature drops below the freezing point, the moisture contained in the blowby gas may freeze in the gas-liquid separator, and the resulting ice may even clog the flow path of the blowby gas in the gas-liquid separator. To overcome this problem, it has been proposed to position the gas-liquid separator inside the head cover in such a manner that a gap is created between the gas-liquid separator and the head cover to minimize the influences of the ambient air on the gas-liquid separator. See JP2009-13941A, for example.

However, according to this prior art, owing to the need to create a gap between the wall of the head cover and the gas-liquid separator, the size of the head cover inevitably increases.

SUMMARY OF THE INVENTION

In view of such a problem of the prior art, a primary object of the present invention is to provide an internal combustion engine provided with a gas-liquid separator for blowby gas that can prevent the clogging of the gas-liquid separator due to freezing without increasing the size of the head cover.

To accomplish such an object, the present invention provides an internal combustion engine (1), comprising: an internal combustion engine main body (20) having a plurality of cylinders (7) formed therein; a head cover (11, 15) attached to an upper end part of the internal combustion engine main body; an exhaust system (34) connected to the internal combustion engine main body; and a gas-liquid separator (45, 60) for blowby gas provided in the head cover; wherein a part of the exhaust system is positioned adjacent to the internal combustion engine main body in a first direction (X) along a cylinder row, and the gas-liquid separator is positioned in the head cover so as to be offset in the first direction.

Since the gas-liquid separator is positioned in a part of the head cover close to the exhaust system, the temperature of the gas-liquid separator is raised owing to the heat received from the exhaust system. As a result, the freezing of moisture contained in the blowby gas in the gas-liquid separator can be prevented even when the ambient air temperature is low. Further, since there is no need to position the gas-liquid separator inside the head cover, the size of the head cover is not required to be increased.

Preferably, the gas-liquid separator is provided with a blowby gas introduction hole in an end part thereof in the first direction.

Since the part of the gas-liquid separation chamber on the side of the blowby gas introduction hole is positioned relatively close to the exhaust system, the temperature of the blowby gas entering the gas-liquid separator is raised owing to the heat received from the exhaust system. As a result, the blowby gas is introduced into the gas-liquid separator at a relatively high temperature so that the freezing of moisture in the gas-liquid separator can be avoided.

According to a preferred embodiment of the present invention, the internal combustion engine main body includes a first cylinder bank (17) and a second cylinder bank (18) arranged in a V-shape, and the head cover includes a first head cover (11) attached to an upper end part of the first cylinder bank, and a second head cover (15) attached to an upper end part of the second cylinder bank, and the gas-liquid separator comprises a first gas-liquid separator provided in the first head cover and a second gas-liquid separator provided in the second head cover. Furthermore, the internal combustion engine main body is fitted with an intake system (23) including a compressor (26A) of a supercharger (26), the first gas-liquid separator being connected to a part of the intake system downstream of the compressor via a first connecting pipe (57), the second gas-liquid separator being connected to a part of the intake system upstream of the compressor via a second connecting pipe (74), and the first gas-liquid separator or the first connecting pipe is provided with a PCV valve (56) configured to permit a flow toward the intake system but to block a flow in an opposite direction.

Thereby, in the V-type internal combustion engine, the temperature of the first gas-liquid separator and the second gas-liquid separator can be raised by the heat received from the exhaust system so that the freezing of moisture in the first gas-liquid separator and the second gas-liquid separator can be avoided.

According to a certain aspect of the present invention, the exhaust system includes a pair of exhaust pipes (35, 36) having upstream ends connected to sides of the first cylinder bank and the second cylinder bank facing away from each other, a turbine (26B) forming the supercharger and connected to downstream ends of the exhaust pipes, and a catalytic converter (37) connected to the turbine, and an inter-bank recessed portion (31) is defined between the first cylinder bank and the second cylinder bank, and the turbine is located adjacent to an end of the inter-bank recessed portion in the first direction.

Thereby, in the V-type internal combustion engine, the temperature of the first gas-liquid separator and the second gas-liquid separator can be raised by the heat received from the turbine of the supercharger so that the freezing of moisture in the first gas-liquid separator and the second gas-liquid separator can be avoided.

Preferably, the first gas-liquid separator is positioned in the first head cover so as to be offset toward the inter-bank recessed portion.

Because the first gas-liquid separator is thereby positioned relatively close to the exhaust system, the first gas-liquid separator is enabled to receive heat from the exhaust system so that the freezing of moisture in the first gas-liquid separator can be avoided.

Preferably, the second gas-liquid separator is positioned in the second head cover so as to be offset toward the inter-bank recessed portion.

Because the second gas-liquid separator is thereby positioned relatively close to the exhaust system, the second gas-liquid separator is enabled to receive heat from the exhaust system so that the freezing of moisture in the second gas-liquid separator can be avoided.

Preferably the catalytic converter is positioned adjacent to the first cylinder bank or the second cylinder bank in the first direction.

Thereby, one of the first gas-liquid separator and the second gas-liquid separator can receive heat from the catalytic converter.

Preferably, the first gas-liquid separator is provided with a first chamber communicating with the blowby gas introduction hole, a second chamber communicating with a blowby gas discharge hole, and a connecting passage communicating with the first chamber and the second chamber, the PCV valve extending from an end of the first gas-liquid separator corresponding to the first direction to the connecting passage, and permitting a flow from the first chamber to the second chamber but blocking a flow in an opposite direction.

Since an end part of the PCV valve is positioned at the end part of the first gas-liquid separator in the first direction, the PCV valve can receive heat from the exhaust system. As a result, the temperature of the PCV valve is raised so that the freezing of moisture contained in the blowby gas in the PCV valve can be prevented.

Thus, according to the present invention, the clogging of the gas-liquid separator in the internal combustion engine due to the freezing of moisture can be avoided without increasing the size of the head cover.

DETAILED DESCRIPTION OF THE PREFERRED EMBODIMENT(S)

An automotive internal combustion engine according to an embodiment of the present invention is described in the following with reference to the appended drawings.

(Internal Combustion Engine Main Body)

Figure 1:
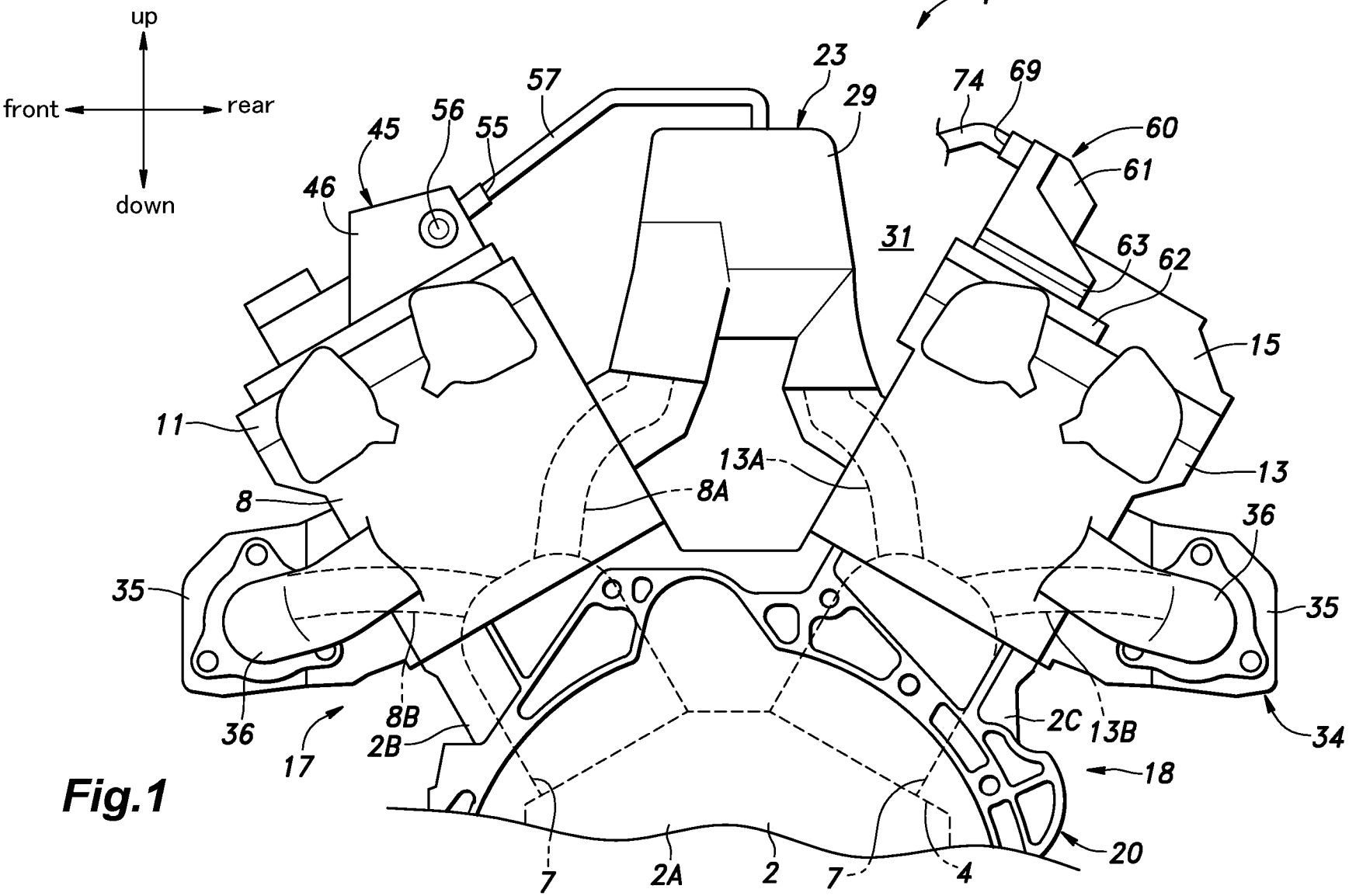
FIG. 1 is a left side view of a laterally mounted V-type internal combustion engine according to an embodiment of the present invention.
Figure 2:
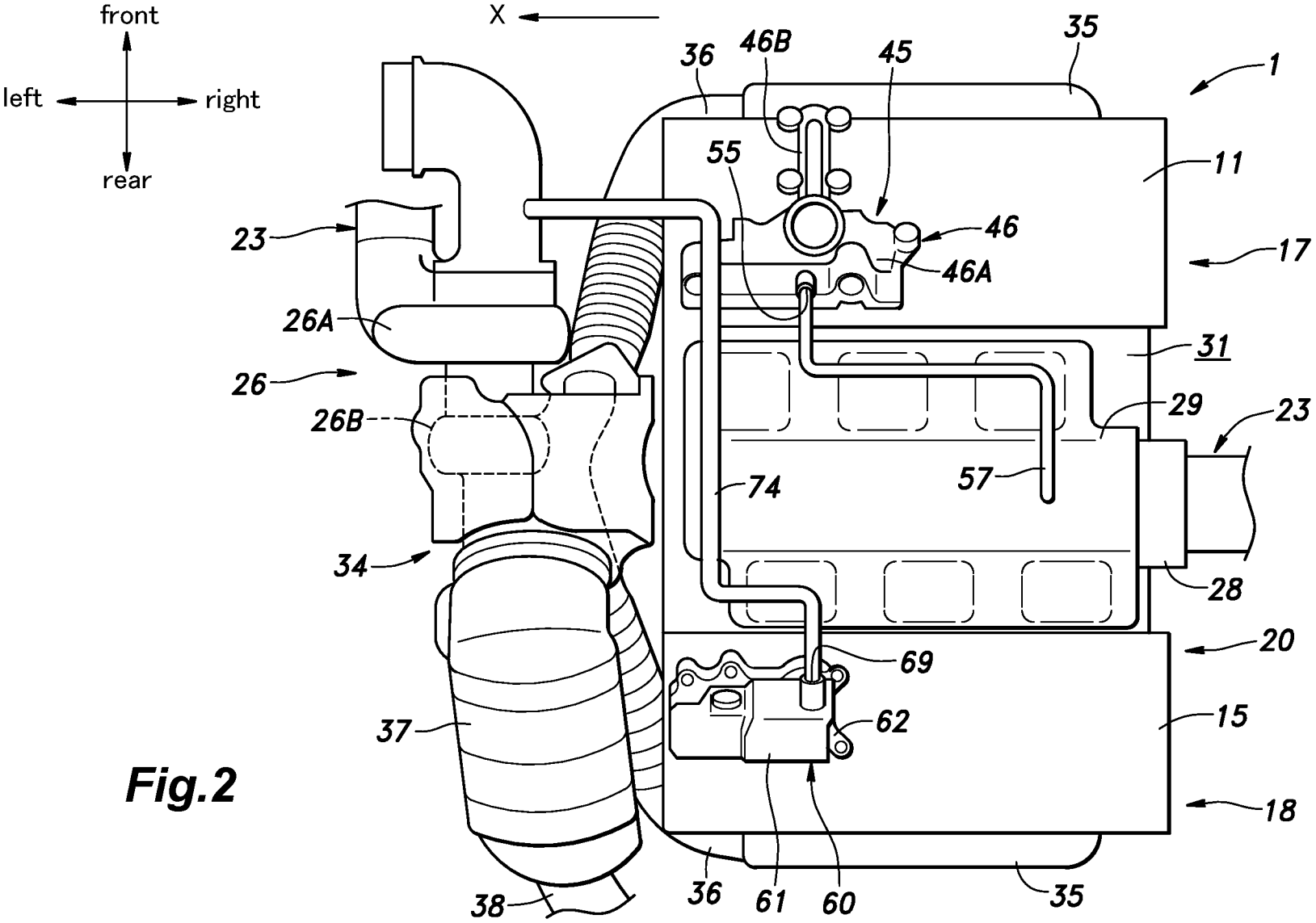
FIG. 2 is a plan view of the internal combustion engine.

As shown in FIG. 1 and FIG. 2, the internal combustion engine 1 consists of a V-type engine, and is laterally mounted in an engine room of a vehicle so that the cylinder rows extend in the lateral direction (transverse direction). The internal combustion engine 1 includes a crankcase 2A provided in a lower part thereof, a front cylinder block 2B provided in an upper front side of the crankcase 2A, a rear cylinder block 2C provided in an upper rear side of the crankcase 2A. The crankcase 2A internally defines a crank chamber 4 that accommodates a crankshaft in a rotatable manner. The crankshaft extends along the cylinder row direction, or in the lateral direction. An oil pan is attached to a lower side of the crankcase 2A.

In each of the front cylinder block 2B and the rear cylinder block 2C, a plurality of cylinders 7 are arranged in the lateral direction. The cylinders 7 of the front cylinder block 2B are inclined forward with respect to the crankshaft, and the cylinders 7 of the rear cylinder block 2C are inclined rearward with respect to the crankshaft. A front cylinder head 8 that closes the upper end of front cylinders 7 is attached to an upper end of the front cylinder block 2B. A front head cover 11 is attached to an upper end of the front cylinder head 8 to jointly define a front valve chamber 9. A rear cylinder head 13 that closes the upper end of the rear cylinders 7 is attached to an upper end of the rear cylinder block 2C. A rear head cover 15 is attached to an upper end of the rear cylinder head 13 to jointly define a rear valve chamber 14.

The front cylinder block 2B, the front cylinder head 8 and the front head cover 11 constitute a front cylinder bank 17 (first cylinder bank). Similarly, the rear cylinder block 2C, the rear cylinder head 13, and the rear head cover 15 constitute a rear cylinder bank 18 (second cylinder bank). The cylinder block 2, the oil pan, the front cylinder head 8, and the rear cylinder head 13 constitute the internal combustion engine main body 20. The front head cover 11 and the rear head cover 15 are attached to the upper end parts of front cylinder head 8 and the rear cylinder head 13 of the internal combustion engine main body 20, respectively.

The front cylinder head 8 is provided with a plurality of intake ports 8A opening out at the rear side of the front cylinder head 8 and communicating with the interior of the front cylinders 7, and a plurality of exhaust ports 8B opening out at the front side of the front cylinder head 8 and communicating with the interior of the front cylinders 7. The rear cylinder head 13 is provided with a plurality of intake ports 13A opening out at the front side of the rear cylinder head 13 and communicating with the interior of the rear cylinders 7, and a plurality of exhaust ports 13B opening out at the rear side of the rear cylinder head 13 and communicating with the interior of the rear cylinders 7.

(Intake Device)

Figure 3:
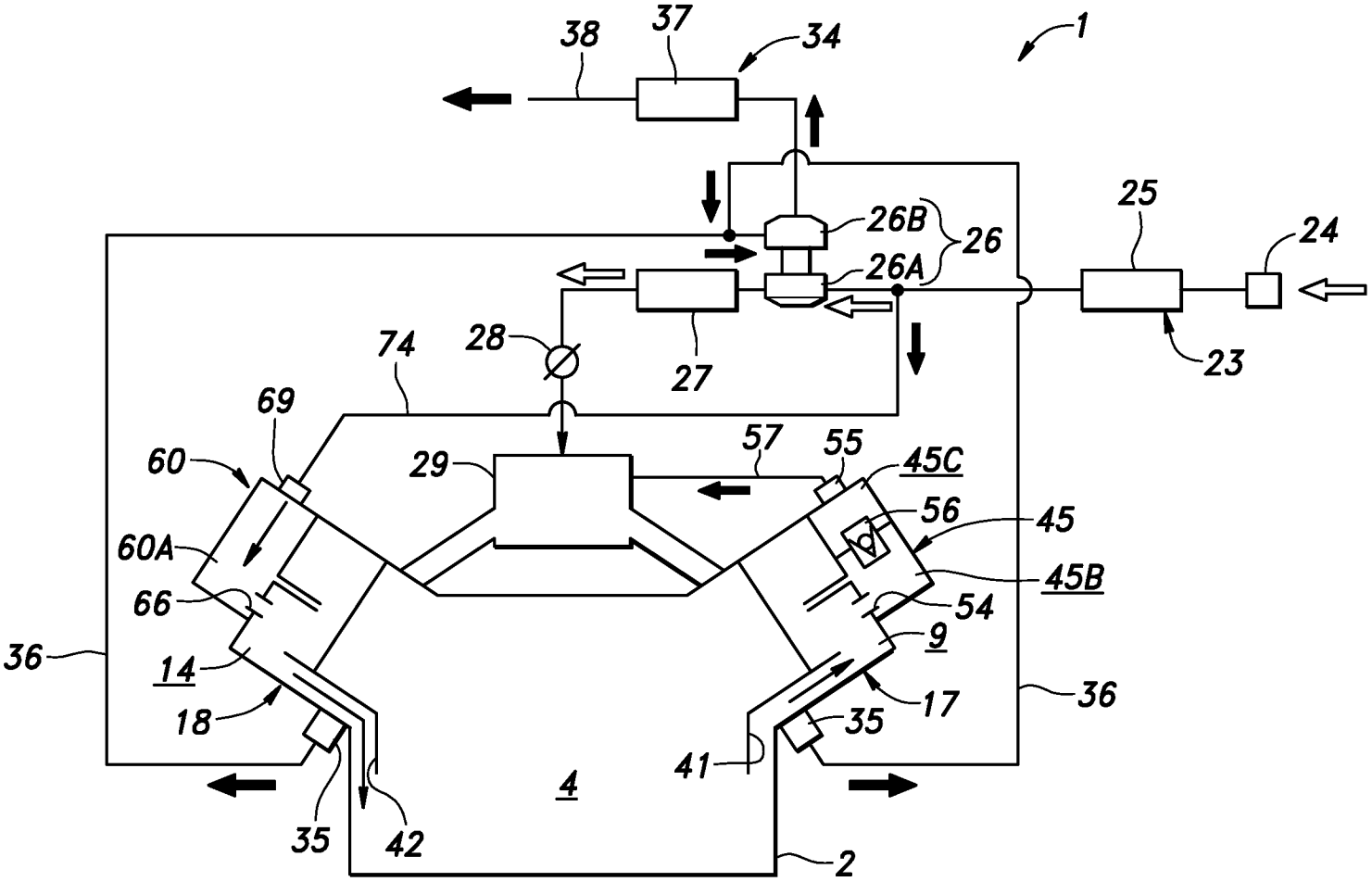
FIG. 3 is a schematic diagram of the internal combustion engine, showing the flow of blowby gas and fresh air in a low load (naturally aspirated) operating condition of the internal combustion engine.

As shown in FIGS. 1 to 3, the intake ports 8A and 13A of the front cylinder head 8 and the rear cylinder head 13 are connected to an intake device 23 (intake system). The intake device 23 includes a series of passages for supplying air to each cylinder 7 of the internal combustion engine 1, and includes an air inlet 24, an air cleaner 25, a compressor 26A of a turbocharger 26 (consisting of a turbocharger in this case), an intercooler 27, a throttle valve 28, and an intake manifold 29, in this order from an upstream end. The intake manifold 29 is positioned in an inter-bank recessed portion 31 formed between the front cylinder bank 17 and the rear cylinder bank 18, and is attached to the rear side face of the front cylinder head 8 and the front side face of the rear cylinder head 13 so as to communicate with the intake ports 8A and 13A of the front cylinder head 8 and the rear cylinder head 13.

(Exhaust Device)

The exhaust ports 8B and 13B of the front cylinder head 8 and the rear cylinder head 13 are connected to an exhaust device 34 (exhaust system). The exhaust device 34 forms a series of passages for discharging the exhaust gas generated in each cylinder 7, and includes a pair of exhaust manifolds 35, a pair of first exhaust pipes 36, a turbine 26B of the turbocharger 26, a catalytic converter 37, and a second exhaust pipe 38 in this order from the upstream end. The second exhaust pipe 38 is provided with a muffler, and the downstream end of the second exhaust pipe 38 constitutes an exhaust outlet. One of the exhaust manifolds 35 is attached to the front side face of the front cylinder head 8, and communicates with the exhaust ports 8B of the front cylinder head 8. The other exhaust manifold 35 is attached to the rear side face of the rear cylinder head 13, and communicates with the exhaust port 13B of the rear cylinder head 13. In other words, the two exhaust manifolds 35 are attached to the sides of the front cylinder head 8 of the front cylinder bank 17 and the rear cylinder head 13 of the rear cylinder bank 18 that face away from each other.

As shown in FIG. 2, a cylinder row direction is defined as a first direction X. In the present embodiment, the left direction corresponds to the first direction X. The turbine 26B is positioned adjacent to the internal combustion engine main body 20 in the first direction X. In particular, the turbine 26B is positioned adjacent to the inter-bank recessed portion 31 in the first direction X in plan view (or adjacent to the left end of the inter-bank recessed portion 31). In the illustrated embodiment, the turbine 26B is spaced from the adjoining end or the left end of the internal combustion engine main body 20. However, according to the present invention, the turbine 26B may slightly overlap with the internal combustion engine main body 20 in the first direction X in plan view. Further, the turbine 26B is spaced from the intake manifold 29 in the first direction X, but may also slightly overlap with the internal combustion engine main body 20 in the first direction X in plan view.

The turbine 26B is positioned so that the rotation axis thereof extends in the fore and aft direction. A compressor 26A of the turbocharger 26 is coaxially positioned in front of the turbine 26B. The two first exhaust pipes 36 extend in the first direction X from the upstream ends thereof connected to the respective intake manifolds 29, and then bend toward the side of the turbine 26B to be connected to the turbine 26B at the downstream ends thereof. As a result, the downstream part of each first exhaust pipe 36 is positioned adjacent to the corresponding cylinder bank in the first direction X.

As shown in FIG. 1, the catalytic converter 37 is provided with a tubular shape, and extends rearward and downward from an upstream end connected to the exhaust outlet of the turbine 26B. The catalytic converter 37 is positioned in the first direction X of the rear cylinder head 13 (or so as to be displaced from the rear cylinder head 13 in the first direction X), and is positioned above a downstream part of the first exhaust pipe 36 on the rear side. In the illustrated embodiment, the catalytic converter 37 is spaced from the opposing end or the left end of the internal combustion engine main body 20. However, according to the present invention, the catalytic converter 37 may slightly overlap with the internal combustion engine main body 20 in the first direction X in plan view.

As shown in FIG. 2, the downstream parts of the first exhaust pipes 36, the turbine 26B and the catalytic converter 37 forming a part of the exhaust device 34 are positioned in the first direction X of the internal combustion engine main body 20 (or so as to be displaced from the internal combustion engine main body 20 in the first direction X). In particular, the downstream part of the first exhaust pipe 36 on the front side is positioned in the first direction X of the front cylinder bank 17 (or so as to be displaced from the front cylinder bank 17 in the first direction X), and the turbine 26B is positioned in the first direction X of the inter-bank recessed portion 31 (or so as to be displaced from the inter-bank recessed portion 31 in the first direction X). Similarly, the downstream part of the first exhaust pipe 36 on the rear side and the catalytic converter 37 are positioned in the first direction X of the rear cylinder bank 18 (or so as to be displaced from the rear cylinder bank 18 in the first direction X). It should be noted that being positioned in the first direction X of a certain component as used herein may mean being adjacent to an end part such as a left end part of a certain component.

(Blowby Gas Passage)

As shown in FIG. 3, a front blowby gas passage 41 connecting the crank chamber 4 with the front valve chamber 9 is formed in the front cylinder block 2B and the front cylinder head 8. A rear blowby gas passage 42 connecting the crank chamber 4 with the rear valve chamber 14 is formed in the rear cylinder block 2C and the rear cylinder head 13.

(Front Gas-Liquid Separator)

Figure 4:
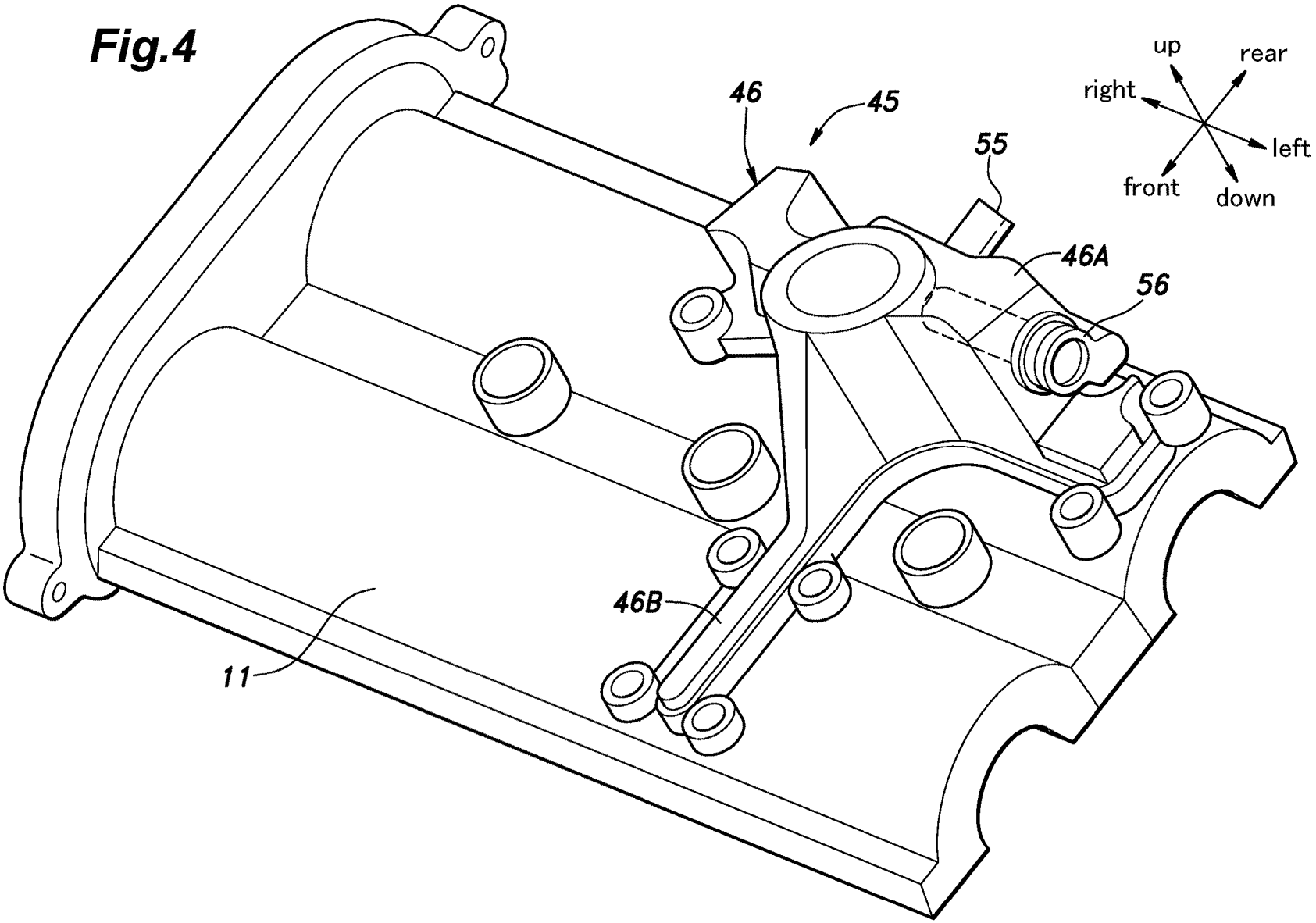
FIG. 4 is a perspective view of a front head cover and a front gas-liquid separator.

As shown in FIGS. 1, 2, and 4, the front head cover 11 is provided with a front gas-liquid separator 45 for separating oil from blowby gas. The front gas-liquid separator 45 is provided so as to be offset from the center (with respect to the cylinder row direction) of the front head cover 11 in the first direction X. In other words, the front gas-liquid separator 45 is displaced from the center of the front head cover 11 in the first direction X. Further, the front gas-liquid separator 45 is provided in a part of the front head cover 11 which is offset from the center (with respect to the fore and aft direction) of the front head cover 11 toward the inter-bank recessed portion 31 (or rearward).

Figure 6:
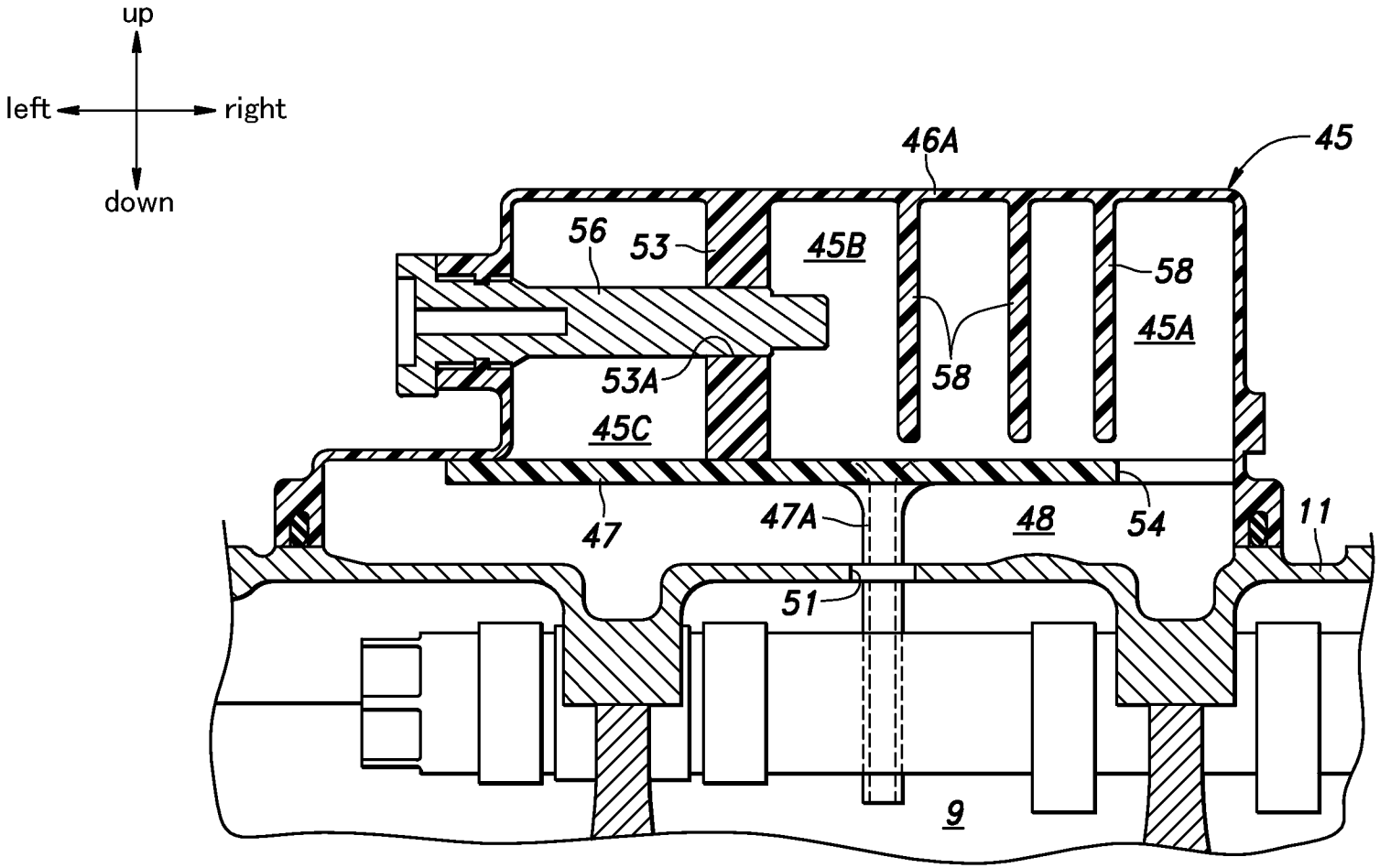
FIG. 6 is a sectional view taken along line VI-VI of FIG. 5.

As shown in FIG. 6, the front gas-liquid separator 45 includes a box-shaped case 46 having an open side facing downward. The case 46 has a main body portion 46A extending laterally along the rear edge of the front head cover 11, and an extension portion 46B extending forward from a substantially laterally central part of the main body portion 46A. The lower side of the case 46 is closed by a bottom plate 47, and a gas-liquid separation chamber 45A is defined between the case 46 and the bottom plate 47. The bottom plate 47 is shaped so as to be conformal to the combined outer profile of the main body portion 46A and the extension portion 46B. The lower edge of the case 46 extends downward beyond the bottom plate 47, and abuts against a seating surface 11A formed on the upper surface of the front head cover 11 via a seal member. As a result, a connecting passage 48 is formed jointly by the upper surface of the front head cover 11, the lower edge of the case 46, and the lower surface of the bottom plate 47.

Figure 5:
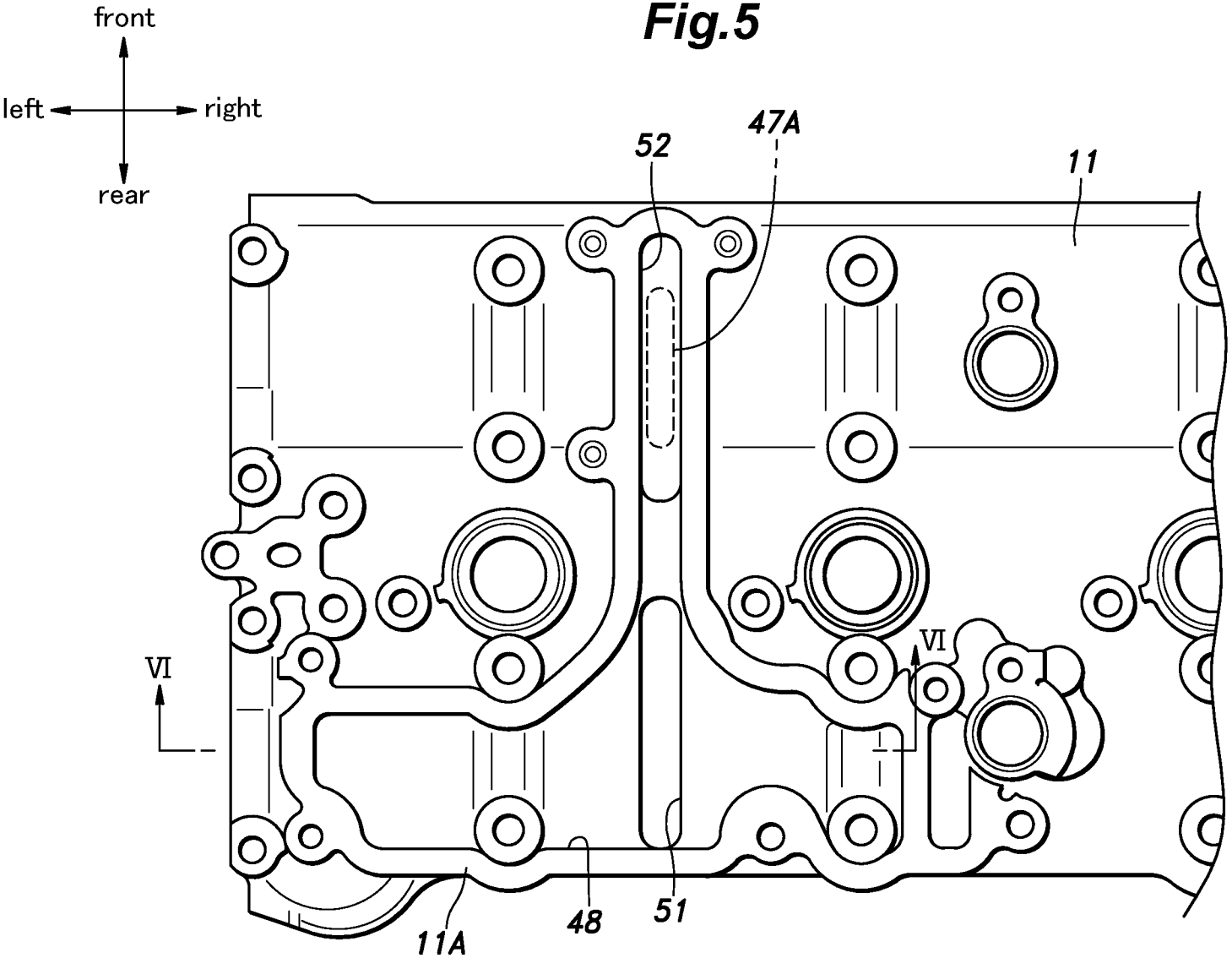
FIG. 5 is a plan view of the front head cover with the front side gas-liquid separator omitted from illustration.

As shown in FIGS. 5 and 6, an inlet hole 51 and a return hole 52 are passed vertically through the upper wall of the front head cover 11 to communicate the front valve chamber 9 with the connecting passage 48. The inlet hole 51 and the return hole 52 are elongated in the fore and aft direction, and the return hole 52 is formed behind the inlet hole 51. The inlet hole 51 is positioned under the main body portion 46A, and the return hole 52 is positioned under the extension portion 46B. A front blowby gas introduction hole 54 is passed vertically through a right end part of the bottom plate 47 to communicate the connecting passage 48 with the gas-liquid separation chamber 45A.

The gas-liquid separation chamber 45A is partitioned into a first chamber 45B and a second chamber 45C by a partition wall 53. The partition wall 53 may be integrally formed with the case 46 or the bottom plate 47. The front blowby gas introduction hole 54 communicates with the first chamber 45B. A front blowby gas discharge hole 55 is formed in a rear wall of the main body portion 46A of the case 46 (see FIG. 4). The front blowby gas discharge hole 55 communicates with the second chamber 45C. The front blowby gas discharge hole 55 communicates with the intake manifold 29 via the first connecting pipe 57.

A connecting passage 53A is formed in the partition wall 53 to communicate the first chamber 45B with the second chamber 45C. The connecting passage 53A is provided with a PCV valve 56 which is configured to be operated by the pressure difference applied thereto. More specifically, the PCV valve 56 opens and permits the gas flow from the first chamber 45B to the second chamber 45C or the gas flow directed toward the intake manifold 29 when the pressure in the second chamber 45C is lower than the pressure in the first chamber 45B by a predetermined value or more, and blocks the flow in the opposite direction. The PCV valve 56 is shaped as an elongated rod, and extends from an end of the main body portion 46A of the case 46 in the X direction (left end) into the first chamber 45B after passing through the second chamber 45C and the connecting passage 53A. As shown in FIGS. 4 and 6, an end part of the PCV valve 56 protrudes from the outer surface of the corresponding end part of the main body portion 46A of the case 46 in the first direction X (in the leftward direction).

As shown in FIG. 6, the first chamber 45B is provided with a plurality of baffle walls 58. The baffle walls 58 are arranged between the front blowby gas introduction hole 54 and the connecting passage 53A so as to meander the flow path of the blowby gas.

The extension portion 46B internally defines a space communicating with the first chamber 45B. An oil discharge pipe 47A extends downward from a part of the bottom plate 47 corresponding to the extension portion 46B. The upper end of the oil discharge pipe 47A opens out at the upper surface of the bottom plate 47. The oil discharge pipe 47A passes through the return hole 52, and the lower end of the oil discharge pipe 47A is positioned in the front valve chamber 9.

(Rear Gas-Liquid Separation Chamber)

Figure 7:
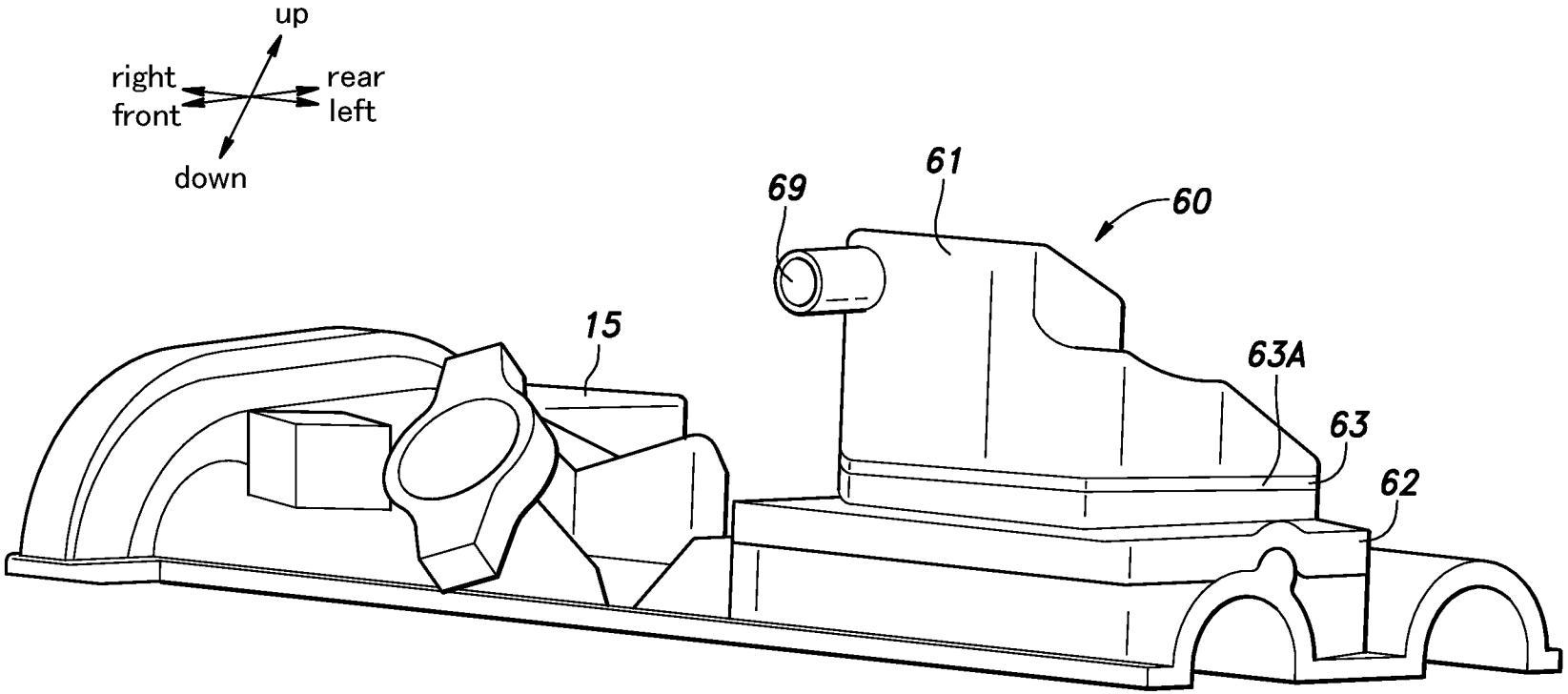
FIG. 7 is a perspective view of a rear head cover and a rear gas-liquid separator.

As shown in FIGS. 1, 2 and 7, the rear head cover 15 is provided with a rear gas-liquid separator 60 for separating oil from blowby gas. The rear gas-liquid separator 60 is offset from the laterally central point of the rear head cover 15 in the first direction X. In other words, the rear gas-liquid separator 60 is displaced from the central point of the rear head cover 15 with respect to the cylinder row direction (in the first direction X). Further, the rear gas-liquid separator 60 is offset from the longitudinally central point of the rear head cover 15 toward the front head cover 11 (or toward the front).

Figure 8:
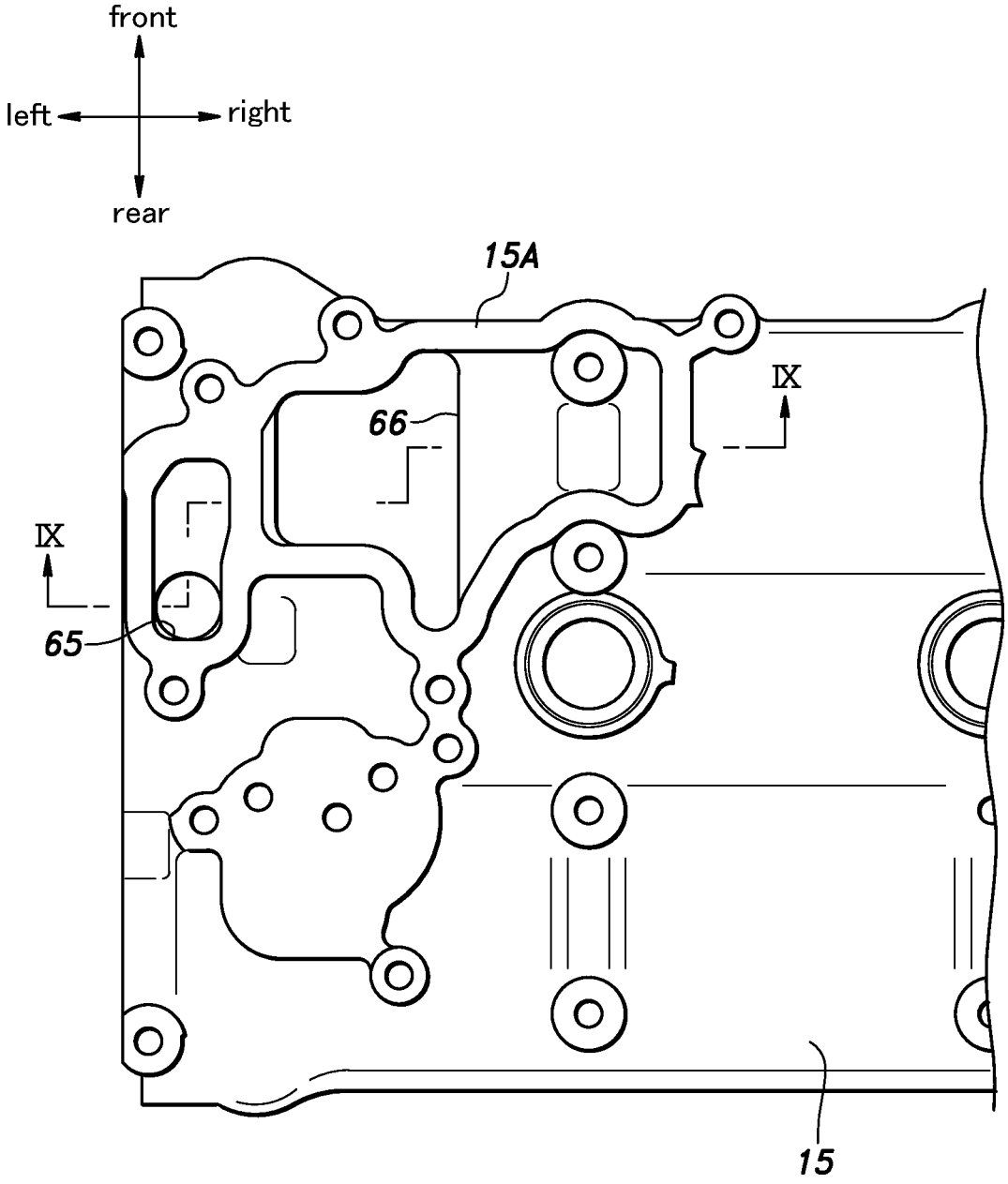
FIG. 8 is a plan view of the rear head cover with the rear gas-liquid separator omitted from illustration.
Figure 9:
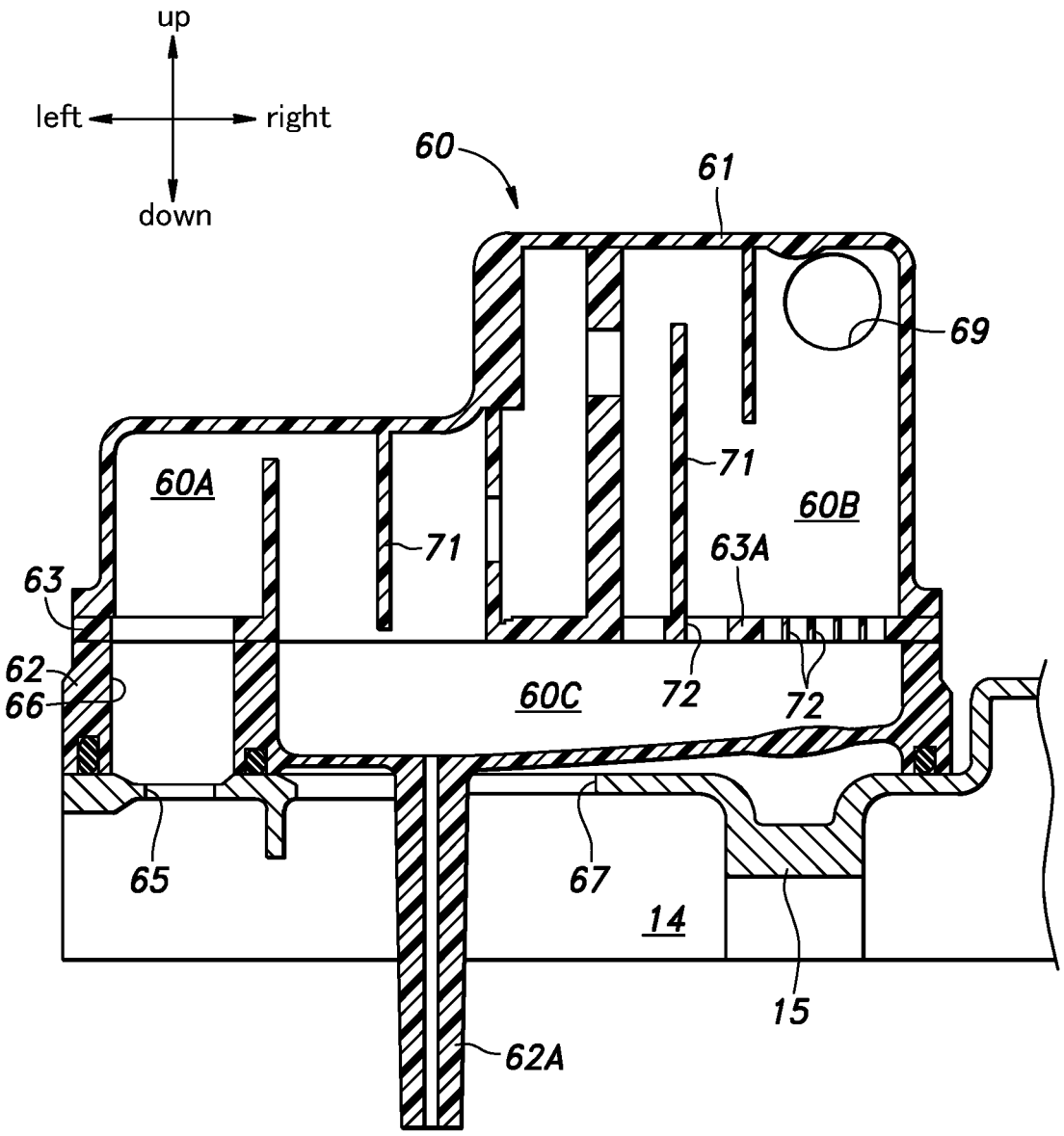
FIG. 9 is a sectional view taken along line IX-IX of FIG. 8.

As shown in FIG. 9, the rear gas-liquid separator 60 includes a box-shaped upper case 61 having an open side facing downward, a box-shaped lower case 62 having an open side facing upward, and a partition wall member 63 interposed between the upper case 61 and the lower case 62. The upper case 61, the lower case 62 and the partition wall member 63 jointly define a gas-liquid separation chamber 60A. The partition wall member 63 includes a partition plate portion 63A that partitions the gas-liquid separation chamber 60A into an upper chamber 60B and a lower chamber 60C. The partition plate portion 63A is sandwiched between the open end of the upper case 61 and the open end of the lower case 62 along the edge portion thereof. The bottom of the lower case 62 of the rear gas-liquid separator 60 is in contact with a seating surface 15A formed on the upper surface of the rear head cover 15 (see FIG. 8).

As shown in FIG. 9, an inlet hole 65 is vertically passed through a terminal end part of the upper wall of the rear head cover 15 in the first direction X. A rear blowby gas introduction hole 66 is passed vertically through the lower case 62 and the partition plate portion 63A in parts thereof corresponding to the inlet hole 65 of the rear head cover 15. The rear blowby gas introduction hole 66 is provided in a terminal end part of the rear gas-liquid separator 60 in the first direction X. A tubular collar integrally extending upward from the bottom plate of the lower case 62 surrounds the rear blowby gas introduction hole 66, and abuts the lower surface of the partition wall member 63 so that the rear blowby gas introduction hole 66 communicates with the upper chamber 60B without communicating with the lower chamber 60C. The lower end of the rear blowby gas introduction hole 66 communicates with the inlet hole 65.

As shown in FIG. 9, the rear head cover 15 is provided with a return hole 67 passed vertically through a part of the upper wall thereof located to the right of the inlet hole 65. An oil discharge pipe 62A extends downward from a part of the bottom wall of the lower case 62 located to the right of the rear blowby gas introduction hole 66. The upper end of the oil discharge pipe 62A opens out at the upper surface of the bottom wall of the lower case 62, and the lower end of the oil discharge pipe 62A is passed downward through the return hole 67, and projects into the rear valve chamber 14. The oil discharge pipe 62A communicates the lower chamber 60C with the rear valve chamber 14.

A rear blowby gas discharge hole 69 is formed in a right end part of the upper case 61. A plurality of baffle walls 71 project upward and downward from the upper surface of the partition plate portion 63A of the partition wall member 63 and the lower surface of the upper case 61, respectively. The baffle walls 71 are arranged between the rear blowby gas introduction hole 66 and the rear blowby gas discharge hole 69 so that a meandering flow path for the blowby gas extending between the rear blowby gas introduction hole 66 and the rear blowby gas discharge hole 69 is defined. A plurality of oil dropping holes 72 are vertically passed through the partition plate portion 63A, in particular near the right end part thereof adjacent to the rear blowby gas discharge hole 69.

The rear blowby gas discharge hole 69 is directed forward, and is connected to a part of the intake device 23 on the upstream side of the compressor 26A via a second connecting pipe 74. This part of the intake device 23 on the upstream side of the compressor 26A may consist of a pipe connecting the compressor 26A with the air cleaner 25.

(Blowby Gas Flow)

The mode of operation of the internal combustion engine 1 configured as described above will be described in the following. As shown in FIG. 3, at the time of natural aspiration with low load, the intake manifold 29 is placed under negative pressure owing to the descent of the pistons in the respective cylinder 7. As a result, the pressure of the second chamber 45C communicating with the intake manifold 29 via the first connecting pipe 57 becomes lower than that of the first chamber 45B by a predetermined value or more. This causes the PCV valve 56 to be opened so that the blowby gas generated in the crank chamber 4 sequentially passes through the front blowby gas passage 41, the front valve chamber 9, the front gas-liquid separation passage, and the first connecting pipe 57, and flows into the intake manifold 29. When passing through the first chamber 45B of the front gas-liquid separator 45, the blowby gas collides with the baffle walls 58, and the oil contained in the blowby gas is separated. The oil separated in the front gas-liquid separator 45 passes through the oil discharge pipe 47A and is discharged to the front valve chamber 9. The oil discharged into the front valve chamber 9 flows into the crank chamber 4 via the front blowby gas passage 41 or an oil return passage (not shown in the drawings).

As the blowby gas flows into the intake manifold 29, negative pressure is created in the crank chamber 4. As a result, fresh air is drawn from the intake device 23 and forwarded to the crank chamber 4 via the second connecting pipe 74, the rear gas-liquid separator 60, the rear valve chamber 14 and the rear blowby gas passage 42. Thus, the crank chamber 4 is ventilated by the fresh air.

Figure 10:
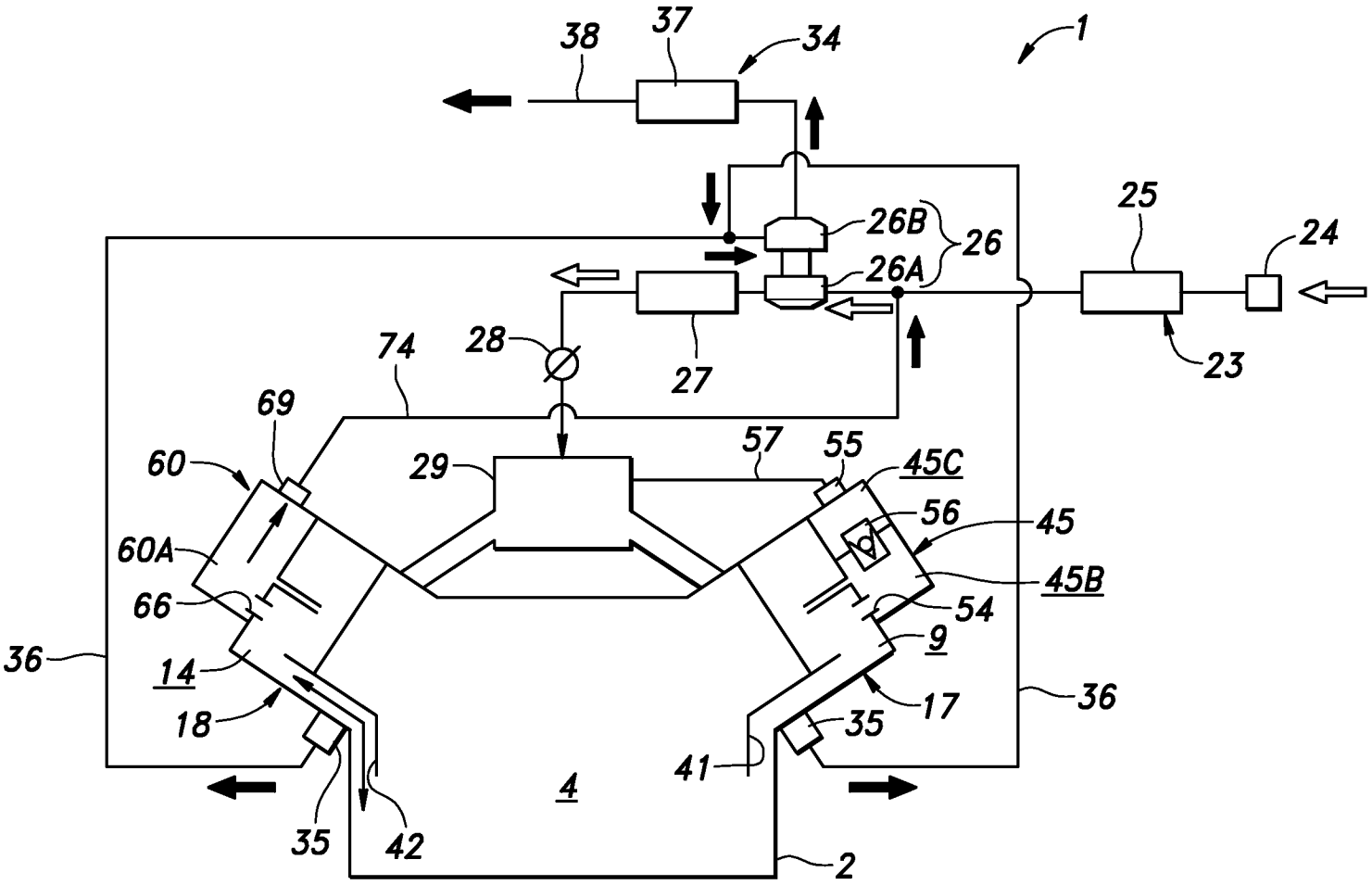
FIG. 10 is a schematic diagram of the internal combustion engine showing a flow of blowby gas and fresh air in a high load (supercharging) operating condition of the internal combustion engine.

As shown in FIG. 10, at the time of supercharging with high load, since the supercharging pressure is applied to the intake manifold 29, the pressure in the second chamber 45C is higher than that in the first chamber 45B so that the PCV valve 56 closes. As a result, the blowby gas generated in the crank chamber 4 is forwarded to a part of the intake device 23 upstream of the compressor 26A of the turbocharger 26 via the rear blowby gas passage 42, the rear valve chamber 14, the rear gas-liquid separator 60 and the second connecting pipe 74. When passing through the rear gas-liquid separator 60, the blowby gas collides with the baffle walls 71, and the oil contained therein is separated. The oil separated in the rear gas-liquid separator 60 passes through the oil discharge pipe 62A, and is discharged to the rear valve chamber 14. The oil discharged to the rear valve chamber 14 flows into the crank chamber 4 via the rear blowby gas passage 42 or an oil return passage (not shown in the drawings).

(Effect)

In this internal combustion engine 1, since the front gas-liquid separator 45 is positioned in the front head cover 11 so as to be offset from the center thereof in the first direction X, the front gas-liquid separator 45 can be positioned in the proximity of the turbine 26B of the exhaust device 34 and the downstream part of the first exhaust pipe 36, or the distances from the front gas-liquid separator 45 to the turbine 26B of the exhaust device 34 and the first exhaust pipe 36 can be minimized. As a result, the front gas-liquid separator 45 receives heat from the turbine 26B and the downstream part of the first exhaust pipe 36, and is therefore warmed during the operation of the internal combustion engine 1. Therefore, even when the ambient air temperature is low, the moisture that is contained in the blowby gas is prevented from freezing in the front gas-liquid separator 45. Further, when the internal combustion engine 1 is stopped, the temperature of the front gas-liquid separator 45 decreases only gradually or at low speed. As a result, the moisture in the front gas-liquid separator 45 can be discharged to the front valve chamber 9 before the temperature of the front gas-liquid separator 45 drops to a level where the moisture starts freezing so that the freezing in the front gas-liquid separator 45 can be avoided. Further, since the front gas-liquid separator 45 is positioned so as to be offset from the center of the front head cover 11 toward the rear or toward the inter-bank recessed portion 31, the distance to the turbine 26B is so small that the heat from the turbine 26B can be transmitted to the front gas-liquid separator 45 in an efficient manner.

The flow path in the front gas-liquid separator 45 is relatively narrow at the PCV valve 56 so that the freezing of the blowby gas is relatively likely to happen in the PCV valve 56. However, in the illustrated embodiment, the PCV valve 56 is positioned in a most displaced position in the front gas-liquid separator 45 in the first direction X, or in the furthest end of the front gas-liquid separator 45 in the first direction X. Therefore, the heat from the turbine 26B and the downstream part of the first exhaust pipe 36 is actively transmitted to the PCV valve 56 so that the temperature of the PCV valve 56 is caused to drop relatively slowly after the engine is cut, and the freezing of the PCV valve 56 can be avoided.

Since the rear gas-liquid separator 60 is arranged in the rear head cover 15 so as to be offset from the center thereof in the first direction X, the distances of the rear gas-liquid separator 60 from the turbine 26B of the exhaust device 34, the catalytic converter 37 and the downstream part of the first exhaust pipe 36 are relatively small. As a result, the rear gas-liquid separator 60 can receive heat from the turbine 26B, the catalytic converter 37, and the downstream part of the first exhaust pipe 36, and is warmed during the operation of the engine. As a result, when the ambient temperature is low, the moisture in the blowby gas is relatively unlikely to be frozen in the rear gas-liquid separator 60. Furthermore, when the internal combustion engine 1 is stopped, the speed of the decrease in the temperature of the rear gas-liquid separator 60 is so gradual that the moisture in the rear gas-liquid separator 60 can be discharged to the rear valve chamber 14 before the temperature of the rear gas-liquid separator 60 drops to a temperature at which freezing occurs, and the freezing of moisture in the separator 60 can be avoided. Furthermore, since the rear gas-liquid separator 60 is positioned in a part of the rear head cover 15 which is adjacent to the inter-bank recessed portion 31 (or on the front side thereof), the distance between the rear gas-liquid separator 60 and the turbine 26B is minimized so that the heat can be received from the turbine 26B all the more actively.

Since the rear blowby gas introduction hole 66 of the rear gas-liquid separator 60 is positioned close to the turbine 26B, the catalytic converter 37 and the downstream part of the first exhaust pipe 36, the blowby gas is warmed in a part of the rear gas-liquid separator 60 adjacent to the rear blowby gas introduction hole 66 so that the blowby gas is allowed to flow through the rear gas-liquid separator 60 at a relatively high temperature. As a result, the moisture in the blowby gas is prevented from freezing in the rear gas-liquid separator 60.

Since the front gas-liquid separator 45 and the rear gas-liquid separator 60 are positioned on the upper sides of the front head cover 11 and the rear head cover 15, respectively, instead of being positioned inside the front head cover 11 and the rear head cover 15, respectively, the front head cover 11 and the rear head cover 15 are not required to be increased in size.

Although the present invention has been described in terms of a specific embodiment, the present invention is not limited by such an embodiment, but can be modified and altered in a number of different ways without departing from the spirit of the present invention.

For instance, the present invention can be applied not only to V-type engines but also to in-line engines. Further, the internal combustion engine 1 is not limited to being placed laterally in the engine room, but may also be arranged longitudinally. It is also possible to provide the front gas-liquid separator 45 connected to the intake manifold 29 via the first connecting pipe 57 in the rear head cover 15, and the rear gas-liquid separator 60 connected to the part of the intake device 23 upstream of the compressor 26A via the second connecting pipe 74 in the front head cover 11.

The invention claimed is:

1. An internal combustion engine, comprising:

an internal combustion engine main body having a plurality of cylinders formed therein;

a head cover attached to an upper end part of the internal combustion engine main body;

an exhaust system connected to the internal combustion engine main body; and a gas-liquid separator for blowby gas provided in the head cover;

wherein a part of the exhaust system is positioned adjacent to the internal combustion engine main body in a first direction along a cylinder row, and the gas-liquid separator is positioned in the head cover so as to be displaced in the first direction, wherein the gas-liquid separator is provided with a blowby gas introduction hole in an end part thereof in the first direction, and wherein the internal combustion engine main body includes a first cylinder bank and a second cylinder bank arranged in a V-shape, and the head cover includes a first head cover attached to an upper end part of the first cylinder bank, and a second head cover attached to an upper end part of the second cylinder bank;

wherein the gas-liquid separator comprises a first gas-liquid separator provided in the first head cover and a second gas-liquid separator provided in the second head cover; and wherein the internal combustion engine main body is fitted with an intake system including a compressor of a supercharger, the first gas-liquid separator being connected to a part of the intake system downstream of the compressor via a first connecting pipe, the second gas-liquid separator being connected to a part of the intake system upstream of the compressor via a second connecting pipe, and the first gas-liquid separator or the first connecting pipe is provided with a PCV valve configured to permit a flow toward the intake system but to block a flow in an opposite direction.

2. The internal combustion engine according to claim 1, wherein the exhaust system includes a pair of exhaust pipes having upstream ends connected to sides of the first cylinder bank and the second cylinder bank facing away from each other, a turbine forming the supercharger and connected to downstream ends of the exhaust pipes, and a catalytic converter connected to the turbine, and wherein an inter-bank recessed portion is defined between the first cylinder bank and the second cylinder bank, and the turbine is located adjacent to an end of the inter-bank recessed portion in the first direction.

3. The internal combustion engine according to claim 2, wherein the first gas-liquid separator is positioned in the first head cover so as to be displaced toward the inter-bank recessed portion.

4. The internal combustion engine according to claim 2, wherein the second gas-liquid separator is positioned in the second head cover so as to be displaced toward the inter-bank recessed portion.

5. The internal combustion engine according to claim 2, wherein the catalytic converter is positioned adjacent to the first cylinder bank or the second cylinder bank in the first direction.

6. The internal combustion engine according to claim wherein the first gas-liquid separator is provided with a first chamber communicating with the blowby gas introduction hole, a second chamber communicating with a blowby gas discharge hole, and a connecting passage communicating with the first chamber and the second chamber, the PCV valve extending from an end of the first gas-liquid separator corresponding to the first direction to the connecting passage, and permitting a flow from the first chamber to the second chamber but blocking a flow in an opposite direction.

* * * * *